US010589972B2

(12) United States Patent
Mark

(10) Patent No.: US 10,589,972 B2
(45) Date of Patent: Mar. 17, 2020

(54) HORIZONTALLY ARTICULATING PLATFORM ARM ASSEMBLY

(71) Applicant: Altec Industries, Inc., Birmingham, AL (US)

(72) Inventor: Jared J. Mark, Saint Joseph, MO (US)

(73) Assignee: Altec Industries, Inc., Birmingham, AL (US)

( * ) Notice: Subject to any disclaimer, the term of this patent is extended or adjusted under 35 U.S.C. 154(b) by 498 days.

(21) Appl. No.: 15/401,404

(22) Filed: Jan. 9, 2017

(65) Prior Publication Data

US 2018/0195589 A1 Jul. 12, 2018

(51) Int. Cl.
*B66F 17/00* (2006.01)
*B66F 11/04* (2006.01)

(52) U.S. Cl.
CPC ..... *B66F 17/006* (2013.01); *B66F 11/046* (2013.01); *B66F 11/044* (2013.01)

(58) Field of Classification Search
CPC .... B66F 17/006; B66F 11/044; B66F 11/046; B66F 13/00
See application file for complete search history.

(56) References Cited

U.S. PATENT DOCUMENTS

| | | | | |
|---|---|---|---|---|
| 7,353,817 | B2 | 4/2008 | Kobel | |
| 8,245,991 | B2 * | 8/2012 | Hung | F16M 11/2021 248/276.1 |
| 2013/0240696 | A1 * | 9/2013 | Black | B66F 7/28 248/226.11 |
| 2016/0176692 | A1 * | 6/2016 | Sawodny | B66F 17/006 701/50 |

FOREIGN PATENT DOCUMENTS

| | | |
|---|---|---|
| CN | 1827520 A | 9/2006 |
| CN | 201121115 Y | 9/2008 |

(Continued)

OTHER PUBLICATIONS

Terex Model TL17i; telescopic tower enterprises pty ltd; Date Printed: Apr. 11, 2017; Date Posted: Unknown; Copyright: 2012: <http://www.telescopictowers.com.au/Page/terex-tl7i-168m>.

(Continued)

*Primary Examiner* — Victor L MacArthur
(74) *Attorney, Agent, or Firm* — Erise IP, P.A.

(57) ABSTRACT

A horizontally articulating platform arm is described. The horizontally articulating platform arm includes a horizontally articulating arm and a rotation limiter. A proximal end of the horizontally articulating arm is configured to be pivotably secured to a boom assembly, and a distal end of the horizontally articulating arm is configured to be pivotably secured to a utility platform assembly. The horizontally articulating arm is configured to be emplaced in an aligned configuration. A first angle is deviated from the aligned configuration between the proximal end and the boom assembly, and a second angle is deviated from the aligned configured between the distal end and the utility platform assembly. The rotation limiter assembly is configured to mechanically prevent a summation of the first angle and the second angle from exceeding a maximum total angle, which may be associated with the utility platform assembly striking the boom assembly or other components.

20 Claims, 6 Drawing Sheets

(56) References Cited

FOREIGN PATENT DOCUMENTS

| | | | | |
|---|---|---|---|---|
| CN | 1303461 | A | | 7/2011 |
| CN | 104176683 | A | | 12/2014 |
| CN | 203976320 | U | | 12/2014 |
| JP | 2582581 | B2 | | 2/1997 |
| JP | 9-136795 | A | | 5/1997 |
| JP | 09136795 | A | * | 5/1997 |
| JP | 9-175791 | A | | 7/1997 |
| JP | 09175791 | A | | 7/1997 |
| JP | H10-120394 | A | | 5/1998 |

OTHER PUBLICATIONS

Aichi HYL5091JGKA Aerial Working Platform; Construction Machinery Online; Date Printed: Apr. 11, 2017; Last Updated: Sep. 19, 2013; Copyright 2002-2017; <http://product.cmsou.com/detail_NDU19---.html>.

First Office Action dated Feb. 19, 2019, in Chinese Patent Application No. 201810010830.0; Applicant: Altec Industries, Inc.

Search Report dated Feb. 19, 2019 in Chinese Patent Application No. 201810010830.0; Applicant: Altec Industries, Inc.

English Translation of the First Office Action and Search Report dated Feb. 19, 2019 in Chinese Patent Application No. 201810010830.0; Applicant: Altec Industries, Inc.

First Office Action dated Nov. 20, 2018, in Japanese Patent Application No. 2018-000677; Applicant: Altec Industries, Inc.

English Translation of the First Office Action dated Nov. 20, 2018, in Japanese Patent Application No. 2018-000677; Applicant: Altec Industries, Inc.

Final Office Action dated Jun. 28, 2019, in Japanese Patent Application No. 2018-000677; Applicant: Altec Industries, Inc.

English Translation of the Final Office Action dated Jun. 28, 2019, in Japanese Patent Application No. 2018-000677; Applicant: Altec Industries, Inc.

* cited by examiner

HORIZONTALLY ARTICULATING PLATFORM ARM ASSEMBLY

BACKGROUND

1. Field

Embodiments of the invention relate to aerial devices and utility platforms. More specifically, embodiments of the invention relate to platform articulating arms.

2. Related Art

Utility workers utilize an aerial device to reach inaccessible locations. The aerial device generally includes a boom assembly with a utility platform connected to a distal end of the boom. One or more utility workers stand in the utility platform. Utility workers typically use an aerial device to access overhead electric power lines and electric power components for installation, repair, or maintenance. In certain environments, such as dense urban or thickly wooded settings, it is difficult to maneuver the utility platform to an orientation in which the utility worker can access the electric power components. This is because these dense environments require precise placement, and may only be accessible from a certain ground location.

Providing a utility platform with the ability to rotate allows the utility platform to access these remote and congested locations. However, providing the utility platform with the ability to rotate presents a problem in that the utility platform may over-rotate and strike the boom, causing damage to the utility platform, the boom, or both. What is lacking in the prior art is a system to allow the rotation of the utility platform while preventing over rotation.

SUMMARY

Embodiments of the invention solve the above-mentioned problems by providing a horizontally articulating platform arm assembly. The horizontally articulating platform arm assembly allows the utility platform to rotate to numerous intermediate positions but mechanically prevents the utility platform from striking the boom, via a rotation limiter.

A first embodiment of the invention is directed to a horizontally articulating platform arm assembly. The horizontally articulating platform arm assembly includes a horizontally articulating arm and a rotation limiter. The horizontally articulating arm presents a proximal end and a distal end. The proximal end of the horizontally articulating arm is configured to be pivotably secured to a boom assembly, and the distal end of the horizontally articulating arm is configured to be pivotably secured to a utility platform assembly. The horizontally articulating arm is configured to be emplaced in an aligned configuration. A first angle is deviated from the aligned configuration between the proximal end and the boom assembly, and a second angle is deviated from the aligned configured between the distal end and the utility platform assembly. The rotation limiter assembly is configured to mechanically prevent a summation of the first angle and the second angle from exceeding a maximum total angle.

A second embodiment of the invention is directed to rotation limiter configured to prevent a horizontally articulating arm from exceeding a maximum total angle. The rotation limiter comprises a proximal angle detector, a distal angle detector, and a cutoff valve assembly. The proximal angle detector is configured to detect a first angle between the horizontally articulating arm and a boom assembly. The distal angle detector is configured to detect a second angle between the horizontally articulating arm and a utility platform assembly. The cutoff valve assembly is configured to prevent movement of the utility platform assembly upon being actuated. The cutoff valve assembly is associated with the distal angle detector and the proximal angle detector such that the cutoff valve assembly is actuated if a summation of the first angle and the second angle exceeds a maximum total angle.

A third embodiment of the invention is directed to a horizontally articulating platform arm assembly comprising a horizontally articulating arm and a rotation limiter. The horizontally articulating arm presents a proximal end and a distal end. The proximal end of the horizontally articulating arm is configured to be pivotably secured to a boom assembly, and the distal end of the horizontally articulating arm is configured to be pivotably secured to a utility platform assembly. The horizontally articulating arm is configured to be emplaced in an aligned configuration. A first angle is deviated from the aligned configuration between the proximal end and the boom assembly, and a second angle is deviated from the aligned configured between the distal end and the utility platform assembly. The rotation limiter assembly is configured to mechanically prevent a summation of the first angle and the second angle from exceeding a maximum total angle. The rotation limiter assembly comprises a proximal angle detector configured to detect the first angle; a distal angle detector configured to detect the second angle; and a cutoff valve assembly configured to prevent movement of the utility platform assembly upon being actuated; and a band secured around the distal angle detector and the proximal angle detector. The cutoff valve assembly is associated with the distal angle detector and the proximal angle detector such that the cutoff valve assembly is actuated if a summation of the first angle and the second angle exceeds the maximum total angle.

A fourth embodiment of the invention is directed to a boom assembly including a boom and a horizontally articulating platform arm. A fifth embodiment of the invention is directed to a utility platform assembly including a utility platform and a horizontally articulating platform arm. A sixth embodiment of the invention is directed to an aerial device including a base, a boom assembly, a utility platform assembly, and a horizontally articulating platform arm. A seventh embodiment of the invention is directed to a method of controlling a horizontally articulating platform arm. An eighth embodiment of the invention is directed to a method of installing an articulating platform horizontally articulating arm between a boom assembly and a utility platform assembly.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
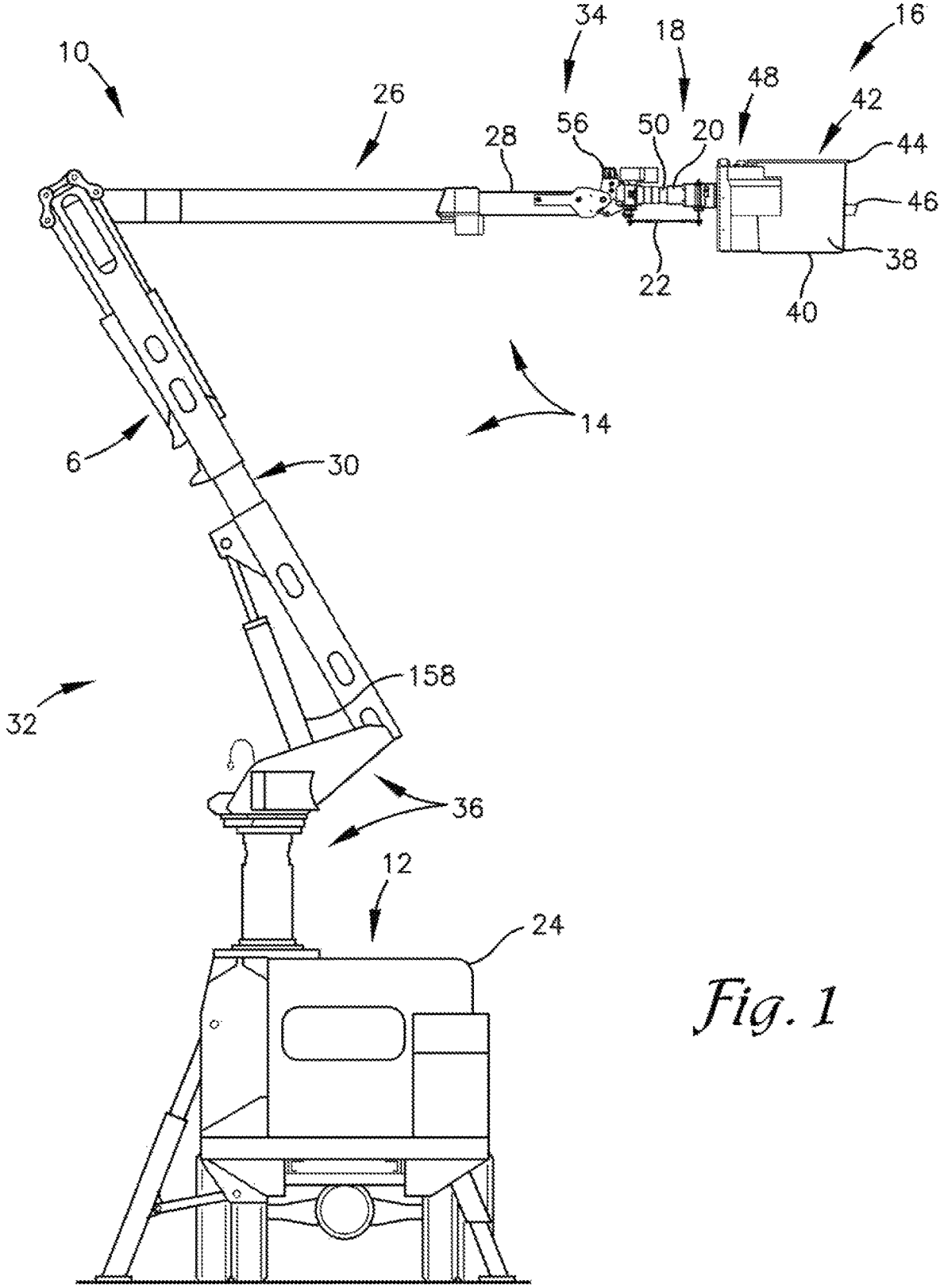
FIG. 1 is an environmental view of an aerial device with a boom assembly, a utility platform assembly and a horizontally articulating platform arm.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Figure 3:
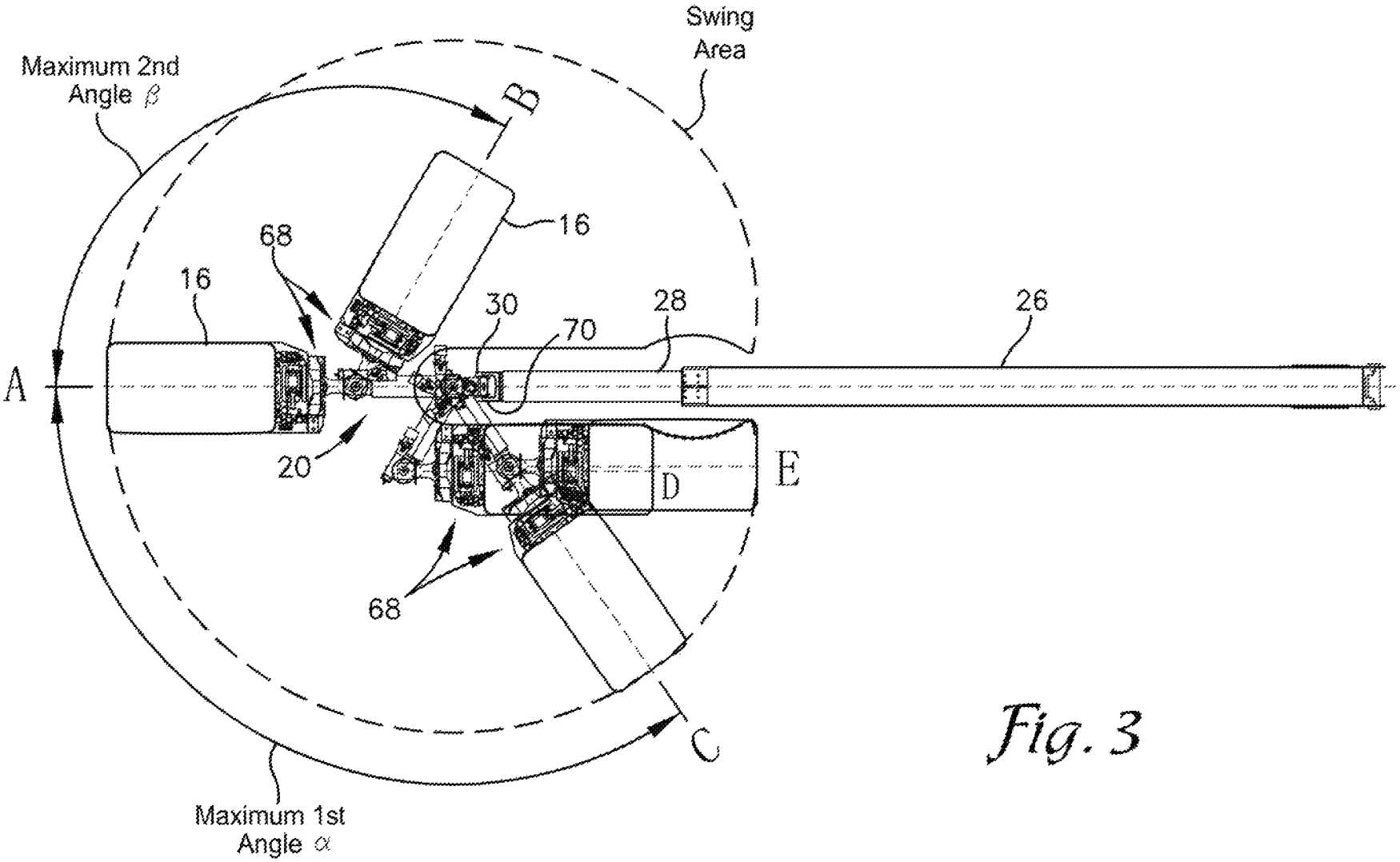
FIG. 3 is a top view illustrating various orientations and locations of the utility platform assembly relative to the boom assembly via the horizontally articulating platform arm.

An aerial device 10, constructed in accordance with various embodiments of the invention, is shown in FIG. 1. The aerial device 10 generally comprises a base with a boom assembly 14 rotatably mounted thereto. A utility platform assembly 16 is disposed on the boom assembly 14 to provide an aerial platform for the accomplishment of a task by a utility worker. A horizontally articulating platform arm 18 is disposed between the boom assembly 14 and the utility platform assembly 16. The horizontally articulating platform arm 18 includes a horizontally articulating arm 20 and a rotation limiter 22. The horizontally articulating platform arm 18 provides a wide array of configurations for utility platform assembly 16 relative to the boom assembly 14 (as illustrated in FIG. 3 and discussed below). Before discussing the components and operation of the horizontally articulating platform arm 18, the other components of the aerial device 10 will be discussed as an exemplary field of use for some embodiments of the invention. It should also be appreciated that embodiments of the invention may be utilized with other implements and tools associated with the boom assembly 14.

The base 12 of the aerial device 10 is a selectively stabilized platform. In embodiments of the invention, the base 12 is a utility truck 24 (as illustrated in FIG. 1), a crane base 12, an oilrig, an earth-working machine, or a fixed structure. The base 12 provides stability and a counterweight to a load being supported by the boom assembly 14. The base 12 also provides a hydraulic power system, pneumatic power system, electrical power system, or other system (not illustrated) that powers the movement of the utility platform assembly 16.

The boom assembly 14 broadly comprises an outer boom section 26 assembly and at least one inner boom section 28. As illustrated in FIG. 1, some embodiments of the boom assembly 14 may further comprise at least one pivoting boom section 30. The boom assembly 14 presents a proximal end 32 and a distal end 34. The proximal end 32 is rotatably and/or pivotably secured to a boom turret 36 of the base 12. The distal end 34 is secured to the horizontally articulating platform arm 18 and/or the utility platform assembly 16. The at least one inner boom section 28 is at least in part disposed within the outer boom section 26 assembly. The at least one inner boom section 28 telescopes to extend or retract into the outer boom section 26 assembly. The pivoting boom section 30 does not telescope out of any other boom section. Instead the pivoting boom section 30 rotates about the base 12, and the outer boom section 26 pivots and/or rotates relative to the pivoting boom section 30. The use of the pivoting boom section 30 allows the utility platform assembly 16 to reach certain areas and avoid obstacles in the working environment.

Figure 2:
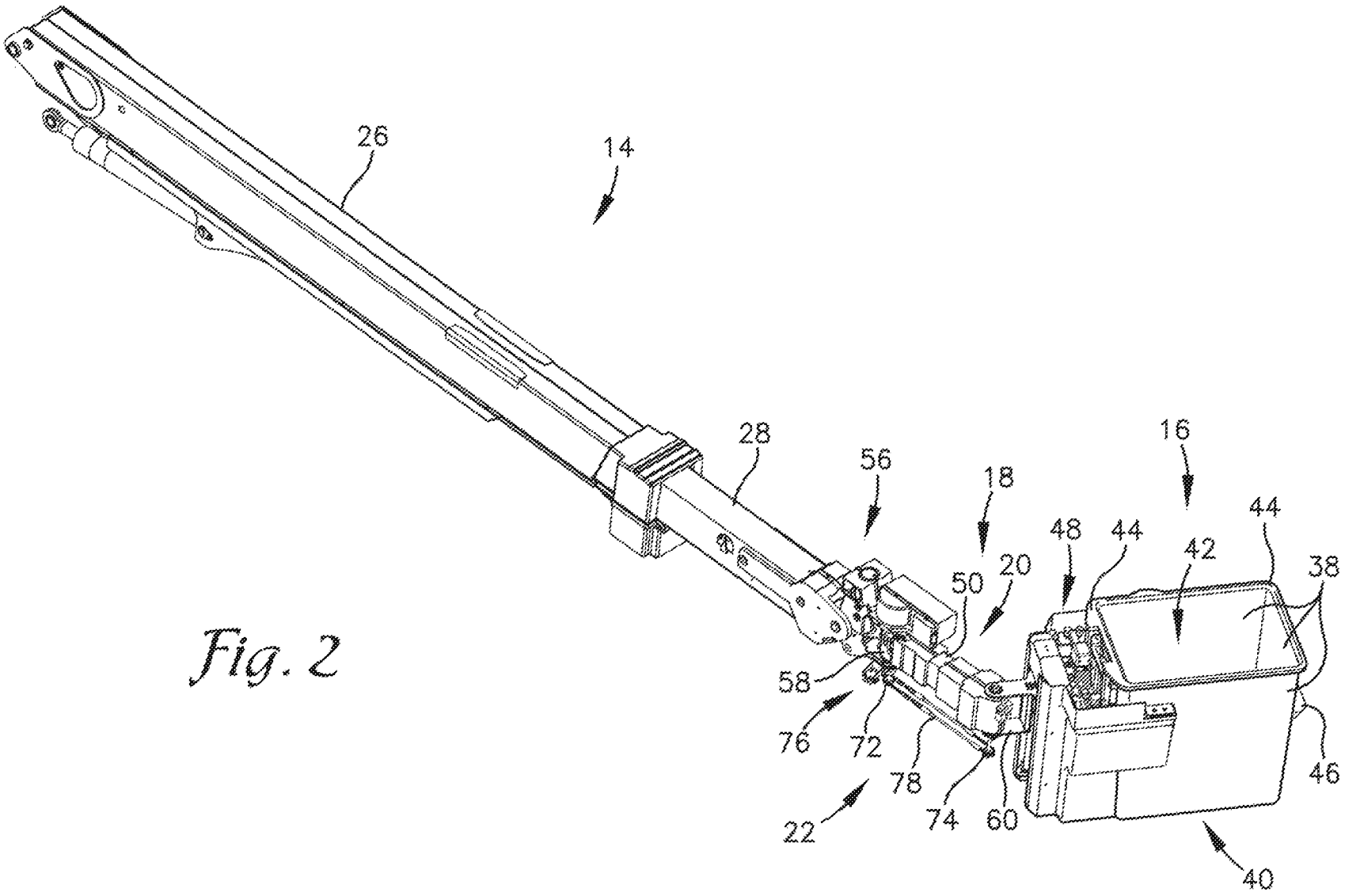
FIG. 2 is a perspective view of the boom assembly, utility platform assembly, and horizontally articulating platform arm of FIG. 1.

The utility platform assembly 16, as best illustrated in FIG. 2, provides an elevated surface from which at least one utility worker can perform a task. As illustrated in FIGS. 1 and 3, embodiments of the utility platform assembly 16 comprise four bucket sidewalls 38 and a bucket floor 40 (best illustrated in FIG. 2) that collectively form a cavity 42. The utility platform assembly 16 may also present a bucket lip 44 along a top portion of at least one bucket sidewall. The utility platform assembly 16 may further comprise a step 46 and/or a door (not illustrated) in at least one of the bucket sidewalls 38 to allow for ingress and egress of the utility worker. The utility platform assembly 16 may also comprise a handrail (not illustrated). The four bucket sidewalls 38 and the bucket floor 40 of the utility platform assembly 16 form the cavity 42. The four bucket sidewalls 38 may be unitary, i.e. formed of a single monolithic structure, or they may be coupled together. The transition between successive bucket sidewalls 38, and/or between the bucket sidewalls 38 and the bucket floor 40, may be rounded or arcuate.

Figure 5:
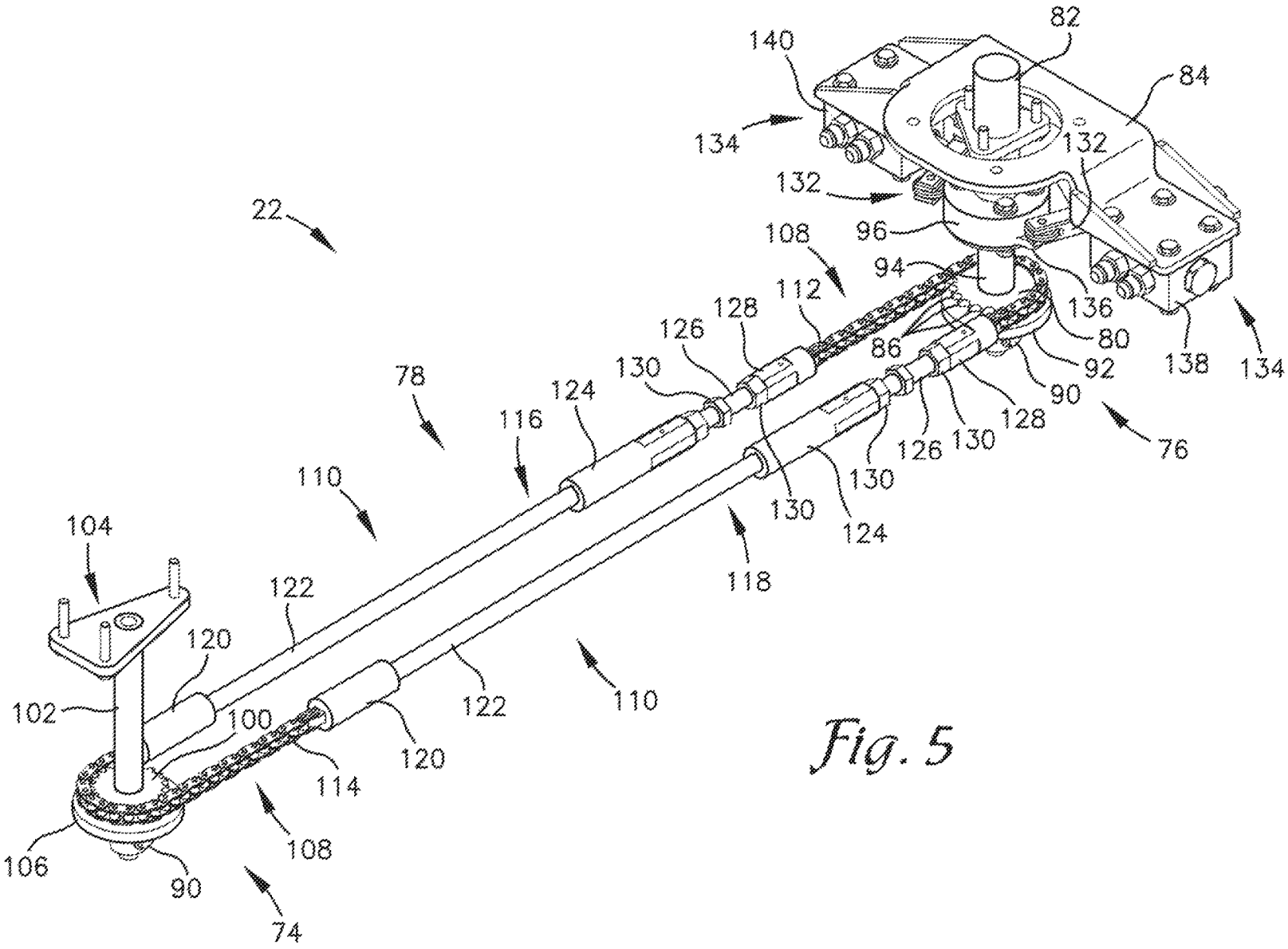
FIG. 5 is a perspective view of a rotation limiter of the platform horizontally articulating arm assembly.

In some embodiments, the utility platform assembly 16 presents a horizontal cross-section that is substantially rectangular. Thus, two of the opposing bucket sidewalls 38 may have a greater width than the other two opposing bucket sidewalls 38. In other embodiments, such as illustrated in FIG. 5, the utility platform assembly 16 presents a horizontal cross-section that is substantially square. Other embodiments of the utility platform assembly 16 may be other shapes about the horizontal cross-section, such as an ellipse, a circle, a D-shape, a triangle, a trapezoid, a rhombus, or other quadrilateral.

In embodiments of the invention, the utility platform assembly 16 further comprises a set of upper boom controls 48, as best illustrated in FIG. 2. The set of upper boom controls 48 are configured to be manipulated by the operator standing in the utility platform assembly 16 so as to move the utility platform assembly 16 and/or the boom assembly 14 to a desired location and configuration. In embodiments, the set of upper boom controls 48 utilize hydraulic power that is supplied in the form of a hydraulic fluid by a set of hydraulic lines (not illustrated). The horizontally articulating platform arm 18 may remove, redirect, or otherwise reduce the hydraulic fluid available to the set of upper boom controls 48 (and/or hydraulic actuators associated therewith) to prevent the utility platform assembly 16 from striking the boom assembly 14 or other component.

In embodiments of the invention, the boom assembly 14 and/or the utility platform assembly 16 further comprises a working jib (not illustrated). The working jib is disposed on the distal end 34 of the boom assembly 14. The working jib is configured to lift objects and perform other tasks as desired by the operator. The working jib has a jib arm that is pivotably secured to the boom assembly 14. A load line extends from the jib arm to be lowered so as to be secured to a load or perform other tasks.

The horizontally articulating platform arm 18 will now be discussed in more detail. In embodiments of the invention, the horizontally articulating platform arm 18 allows the utility platform assembly 16 to be placed into more locations and orientations than a traditional utility platform assembly 16 can achieve, relative to the boom assembly 14. These additional locations and orientations may allow the operator to reach around and through obstacles so as to position the utility platform assembly 16 in a desired location and/or orientation for the performance of a task. As an example, the operator may maneuver the utility platform assembly 16 between two buildings in a dense urban setting. As another example, the operator may maneuver the utility platform assembly 16 around a tree so as to access a utility pole.

Traditional utility platform assemblies pivot relative to the boom assembly 14 about a single pivot axis. In contrast, the horizontally articulating platform arm 18 provides at least two pivot axes for rotation of the utility platform assembly 16 therearound, being separated by the horizontally articulating arm 20. This provides the operator with greater control and flexibility in maneuvering the utility platform assembly 16. It may also reduce the need for the operator to precisely place the base 12 of the aerial device 10, as the operator has more control over the location and orientation of the utility platform assembly 16 once operational.

Figure 4:
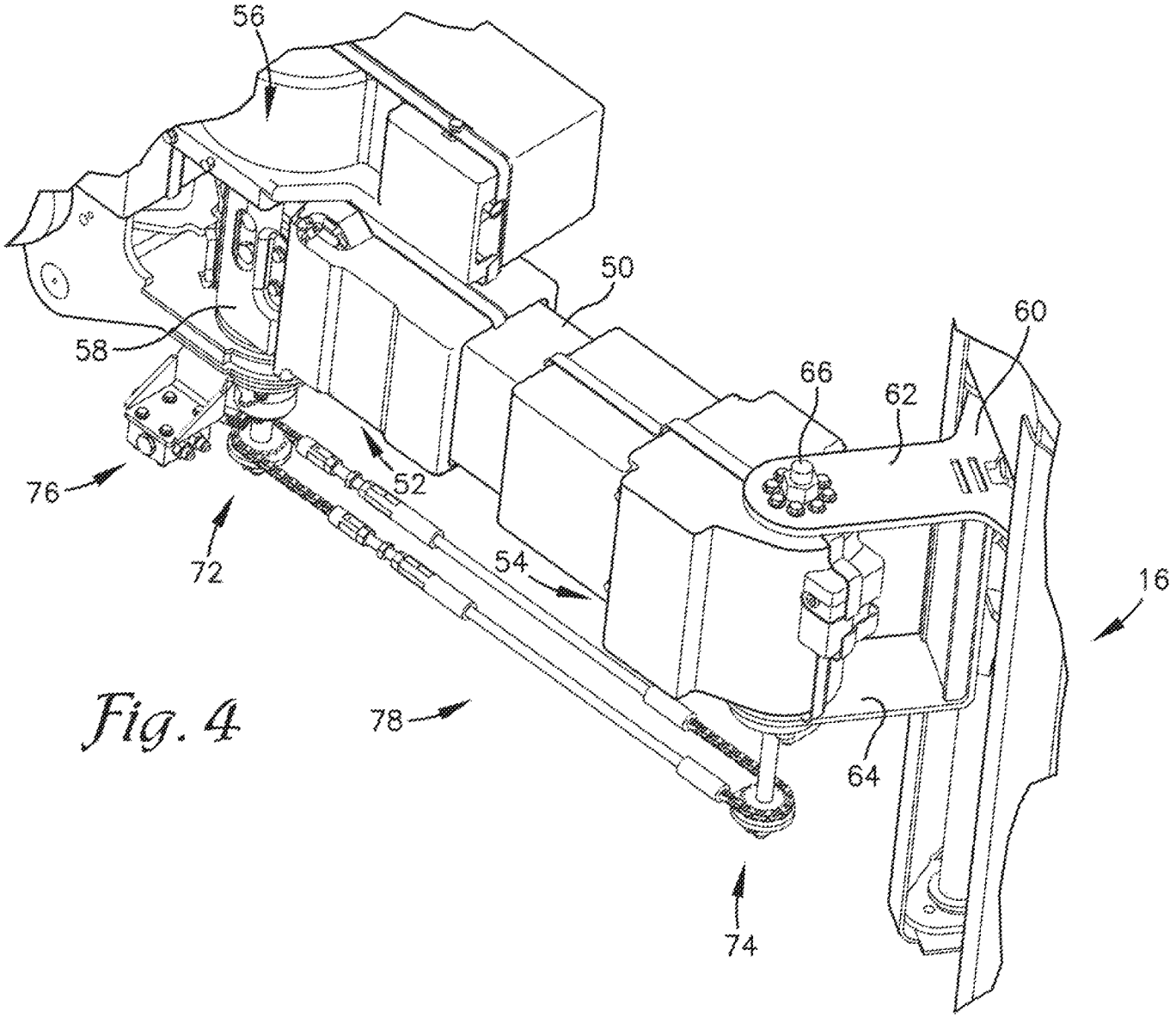
FIG. 4 is a perspective view of the horizontally articulating platform arm.

In embodiments of the invention, horizontally articulating platform arm 18 comprises the horizontally articulating arm 20 and the rotation limiter 22, as best illustrated in FIG. 4. The horizontally articulating arm 20 provides a lateral separation between the two aforementioned rotation axes. The horizontally articulating arm 20 also provides structural support for the utility platform assembly 16 and/or other implements disposed on the boom assembly 14. The rotation limiter 22 prevents over rotation of a maximum total angle. The maximum total angle is a summation of two angles of the horizontally articulating platform arm 18 that prevent the horizontally articulating platform arm 18 from striking the boom assembly 14. In embodiments, the rotation limiter 22 allows either angle to exceed half of the maximum total angle, but prevents the summation from exceeding the maximum total angle (as discussed more below). The rotation limiter 22 therefore allows flexibility to the operator in selecting the two angles.

The horizontally articulating arm 20 is an elongated member 50 that presents a proximal end 52 and a distal end 54. In some embodiments, the horizontally articulating arm 20 is formed of a polymer or other insulated material, so as to prevent or reduce a discharge of electricity through the horizontally articulating arm 20, the boom assembly 14, and the base 12 of the aerial device 10. The proximal end 52 of the horizontally articulating arm 20 is configured to be pivotably secured to the boom assembly 14. In embodiments of the invention, the proximal end 52 is pivotably secured to the boom assembly 14 at a platform leveler 56. The platform leveler 56 is a component of the boom assembly 14 that ensures the platform remains substantially level despite the angle of the boom assembly 14 relative thereto. Securing the proximal end 52 of the horizontally articulating arm 20 to the platform leveler 56 ensures that the horizontally articulating arm 20 remains substantially level during movement. This simplifies the movement as understood by the operator and allows the operator greater control over the placement of the utility platform assembly 16. In other embodiments of the invention, the platform leveler 56 is secured to the distal end 54 of the horizontally articulating arm 20, or the platform leveler 56 is independent of the horizontally articulating arm 20.

The proximal end 52 of the horizontally articulating arm 20 is pivotably secured to the platform leveler 56 (or other component of the boom assembly 14) via a proximal pivot 58. The proximal pivot 58 allows the horizontally articulating arm 20 to rotate relative the platform leveler 56. The proximal pivot 58 is also associated with the rotation limiter 22, such that an angle to which the proximal pivot 58 is pivoted relative to a default aligned configuration (as illustrated in FIG. 1) can be determined (as discussed below)

The distal end 54 of the horizontally articulating arm 20 is configured to be pivotably secured to the utility platform assembly 16. In embodiments of the invention, the distal end 54 of the horizontally articulating arm 20 is pivotably secured to the utility platform assembly 16 at a platform yoke 60. The platform yoke 60 is configured to secure the horizontally articulating arm 20 so as to allow pivoting relative thereto. The platform yoke 60 may include a first protrusion 62, a second protrusion 64, and a distal pivot 66. A distal pivot 66 traverses through the first protrusion 62, an opening in the horizontally articulating arm 20 (not illustrated), and the second protrusion 64. The distal pivot 66 is also associated with the rotation limiter 22 such that an angle to which the distal pivot 66 is pivoted relative to the default aligned configured can be determined (as discussed below).

The horizontally articulating arm 20 is configured to be emplaced in an aligned configuration, as illustrated in FIG. 3. FIG. 3 illustrates numerous possible positions into which the utility platform assembly 16 can be emplaced via the horizontally articulating platform arm 18. There are five illustrative orientations in FIG. 3, labeled as A, B, C, D, and E. Each will be discussed in turn. The illustrative orientations are achieved by pivoting the horizontally articulating arm 20 and/or the utility platform assembly 16 about their respective pivot axes.

Orientation A illustrates the utility platform assembly 16 in the aligned configuration. In the aligned configuration, the utility platform assembly 16, the horizontally articulating arm 20, and the boom assembly 14 are substantially coaxially aligned. In the other illustrated orientations, a first angle $\alpha$ is deviated from the aligned configuration between the proximal end 52 and the boom assembly 14, and/or a second angle $\beta$ is deviated from the aligned configured between the distal end of the horizontally articulating arm and the utility platform assembly 16.

Orientation B illustrates the utility platform assembly 16 in which the first angle is zero (e.g., the aligned configuration) and the second angle is at a maximum second angle (as labeled in FIG. 3, approximately 120 degrees in the example shown). The maximum second angle is the maximum angular displacement that is allowed relative to the horizontally articulating arm 20 regardless of the first angle. As can be seen, the maximum second angle prevents a corner 68 of the utility platform assembly 16 from striking the horizontally articulating arm 20. The maximum second angle is enforced by a mechanical stop associated with the utility platform assembly 16, the platform yoke 60, the horizontally articulating arm 20, or other component. The mechanical stop physically prevents the utility platform assembly 16 from exceeding the maximum second angle. An example of a mechanical stop may also include an end of a stroke within a rotary actuator.

Orientation C illustrates the utility platform assembly 16 in which the first angle is at a maximum first angle (as labeled in FIG. 3, approximately 125 degrees in the example shown) and the second angle is zero (e.g., the aligned configuration). The maximum first angle is the maximum angular displacement that is allowed relative to the boom assembly 14 regardless of the second angle. As can be seen, the maximum first angle prevents the horizontally articulating arm 20 from striking a corner 70 of the boom assembly 14 (such as the platform leveler 56). The maximum first angle is enforced by a mechanical stop associated with the horizontally articulating arm 20, the platform leveler 56, the boom assembly 14, or other component. The mechanical stop physically prevents the horizontally articulating arm 20 from exceeding the maximum first angle.

It should be noted that the maximum first angle and the maximum second angle are independent figures that are determined by the geometry of the respective components. In these exemplary illustrated embodiment, approximately 125 degrees is the maximum first angle and approximately 120 degrees is the maximum second angle. However, it should be appreciated that other sizes, shapes, and displacements of the various components may render the maximum first angle and the maximum second angle to a different value. For example, if the utility platform assembly 16 were substantially tear-drop shaped or elliptical (such that the utility platform assembly 16 has no or a reduced corner 68 to strike the horizontally articulating arm 20) the maximum second angle may be larger than as illustrated. As another example, if the boom assembly 14 is larger than as illustrated, the maximum first angle may be reduced.

Orientations D and E illustrate the utility platform assembly 16 in two exemplary maximum total angles. As discussed above, the maximum total angle is a summation of the first angle and the second angle. In embodiments of the invention, the maximum total angle is less than a summation of the maximum first angle and the maximum second angle. For example, the maximum total angle may be at the maximum second angle and a less-than-maximum first angle (as illustrated in Orientation D). As another example, the maximum total angle may be at the maximum first angle and a less-than maximum second angle (as illustrated in Orientation E). As yet another example, the maximum total angle may be at a less-than maximum first angle and a less-than maximum second angle (not illustrated). The maximum total angle in the exemplary illustrations may be approximately 180 degrees. As with the individual maximum angles, embodiments of the invention may utilize another maximum total angle based upon the relative sizes, geometries, and displacements of the various components.

The maximum total angle is therefore associated with the utility platform assembly 16 striking the boom assembly 14. As such, the rotation limiter 22 prevents the utility platform assembly 16 from striking the boom assembly 14, while allowing free motion of the utility platform assembly 16 throughout the swing area (as illustrated in FIG. 3). The swing area illustrates the available locations for the utility platform assembly 16 relative to the boom that are possible with the exemplary horizontally articulating arm 20 and rotation limiter 22. It should be appreciated that other sizes and shapes of the swing area may be possible with other embodiments of the invention.

Figure 6:
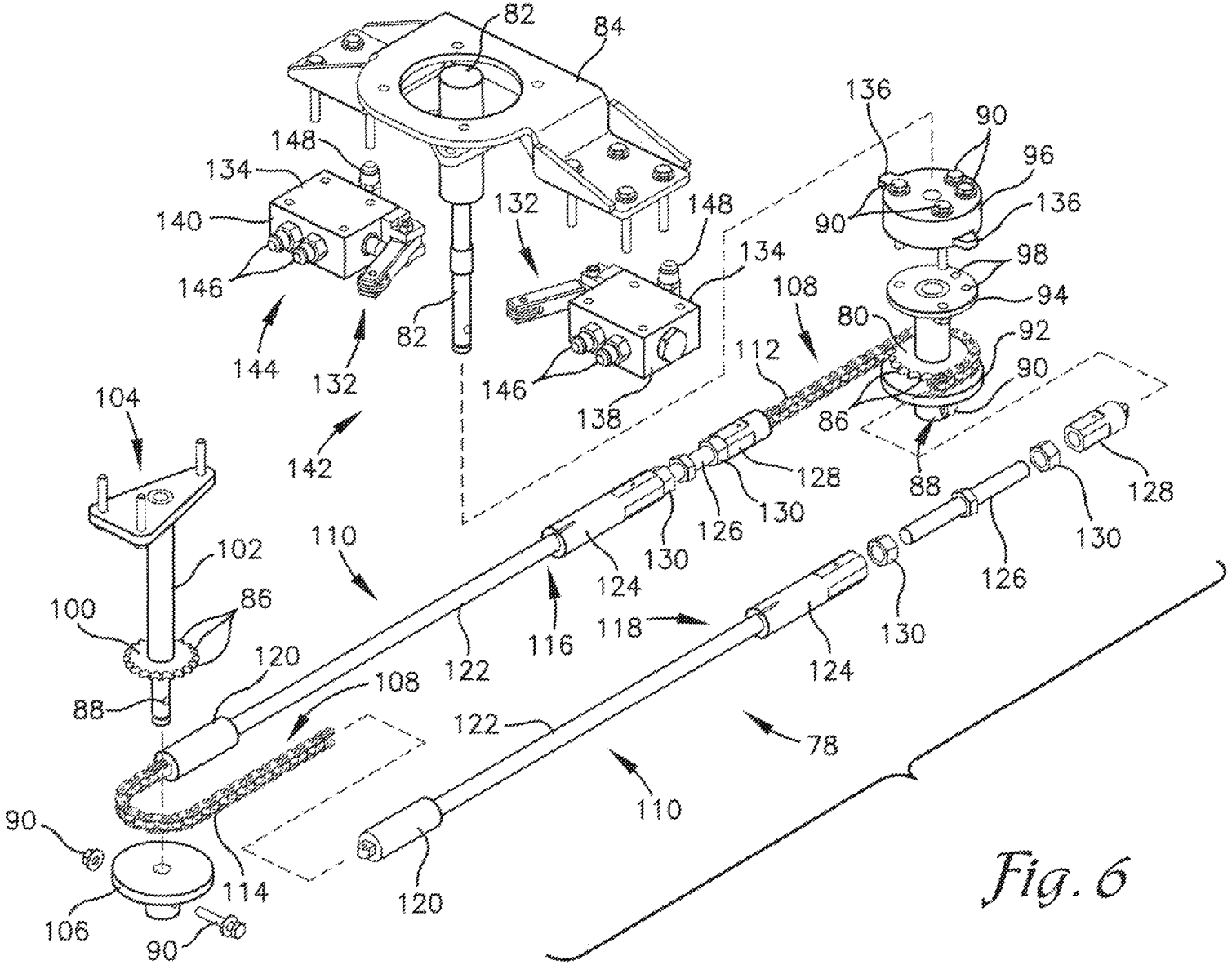
FIG. 6 is an exploded view of the rotation limiter of FIG. 5.

The rotation limiter 22 will now be discussed in greater detail. The rotation limiter 22 is best illustrated in FIGS. 5 and 6. It should be appreciated that in some embodiments of the invention, the rotation limiter 22 may be disposed within a housing that protects the rotation limiter 22. The housing is not illustrated in any figures (specifically FIG. 1, 2, or 4) for clarity. The rotation limiter 22 is configured to mechanically prevent a summation of the first angle and the second angle from exceeding a maximum total angle. In some embodiments of the invention, the rotation limiter 22 prevents the summation from exceeding the maximum total angle by cutting hydraulic power to the utility platform assembly 16 and/or the horizontally articulating platform arm 18. The cutting of hydraulic power may be by opening a hydraulic valve so as to dump the hydraulic fluid back to a hydraulic tank. The rotation limiter 22 is therefore configured to mechanically prevent a summation of the first angle and the second angle from exceeding a maximum total angle.

In embodiments of the invention, as best illustrated in FIGS. 4-6, the rotation limiter 22 comprises a proximal angle detector 72, a distal angle detector 74, a cutoff valve assembly 76, and a band 78. The proximal angle detector 72 is configured to detect the first angle. The distal angle detector 74 is configured to detect the second angle. The cutoff valve assembly 76 is configured to prevent movement of the utility platform assembly 16 upon being actuated. In some embodiments, the cutoff valve assembly 76 is associated with the distal angle detector 74 and the proximal angle detector 72 such that the cutoff valve assembly 76 is actuated if a summation of the first angle and the second angle exceeds the maximum total angle. The band 78 is secured around the distal angle detector 74 and the proximal angle detector 72.

As best illustrated in FIG. 4, the proximal angle detector 72 is configured to detect the first angle between the horizontally articulating arm 20 and a boom assembly 14. In embodiments of the invention, the proximal angle detector 72 comprises a proximal sprocket 80, a proximal post 82, and a boom interface bracket 84. The proximal sprocket 80 configured to receive at least a portion of the band 78 therearound. The proximal sprocket 80 may present a series of protrusions 86 configured to interface with the band 78. The proximal sprocket 80 may rotate in relation to the band 78 rotating therearound, the horizontally articulating arm 20 rotating therearound, or both.

The proximal post 82 is axially aligned with and secured to the proximal sprocket 80. The proximal post 82 translates a rotation of the horizontally articulating arm 20 relative to the boom assembly 14 (the first angle discussed above) to a corresponding rotation of the proximal sprocket 80. The proximal post 82 provides a pivoting axis (as discussed above) for the horizontally articulating arm 20 relative to the boom assembly 14. In embodiments of the invention, the proximal post 82 may include an opining 88 in a lower end of the proximal post 82. The opining 88 is configured to receive a fastener 90 therethrough so as to secure the proximal post 82 to another component of the proximal angle detector 72.

The proximal angle detector 72 may further comprise a proximal band support 92 disposed below the proximal sprocket 80. The proximal band support 92 keeps the band 78 aligned to and in contact with the proximal sprocket 80. The proximal angle detector 72 may further comprise a cam mount 94 that is configured to support a cam wheel 96 of the cutoff valve assembly 76 (as discussed below). The cam mount 94 may present a set of openings 98 for the receipt of a set of fasteners 90 therethrough. The fasteners 90 secure the cam wheel 96 to the cam mount 94 and keep the cam wheel 96 aligned with the proximal post 82 and the proximal sprocket 80. In other embodiments, the cam mount 94 and the cam wheel 96 may be associated with the distal angle detector 74.

The boom interface bracket 84 is associated with the boom assembly 14 (and/or a component thereof, such as the platform leveler 56). In embodiments of the invention, the proximal post 82 is fixedly secured to the horizontally articulating arm 20 such that the proximal post 82 rotates with the horizontally articulating arm 20. The proximal post 82 and the proximal sprocket 80 rotate by the first angle as the horizontally articulating arm 20 rotates by the first angle. The boom interface bracket 84 may therefore secure the proximal post 82 to the horizontally articulating arm 20 and/or at least a portion of the cutoff valve assembly 76 to a position proximate the proximal angle detector 72 (as discussed below).

As best illustrated in FIG. 4, the distal angle detector 74 is configured to detect the second angle between the horizontally articulating arm 20 and the utility platform assembly 16. In embodiments of the invention, the distal angle detector 74 comprises a distal sprocket 100, a distal post 102, and a platform interface bracket 104. The distal sprocket 100 configured to receive at least a portion of the band 78 therearound. The distal sprocket 100 may present a series of protrusions 86 configured to interface with the band 78. The distal sprocket 100 may rotate in relation to the band 78 rotating therearound, the utility platform assembly 16 rotating therearound, or both.

The distal post 102 is axially aligned with and secured to the distal sprocket 100. The distal post 102 translates a rotation of the utility platform assembly 16 relative to the horizontally articulating arm 20 (the second angle discussed above) to a corresponding rotation of the distal sprocket 100. The distal post 102 provides a pivoting axis (as discussed above) for the utility platform assembly 16 relative to the horizontally articulating arm 20. In embodiments of the invention, the distal post 102 may include an opining 88 in a lower end of the distal post 102. The opining 88 is configured to receive a fastener 90 therethrough so as to secure the distal post 102 to another component of the distal angle detector 74 (such as the distal band support 106 discussed below). The distal angle detector 74 may further comprise a distal band support 106 disposed below the distal sprocket 100. The distal band support 106 keeps the band 78 aligned to and in contact with the distal sprocket 100.

The platform interface bracket 104 is associated with the utility platform assembly 16 (and/or a component thereof, such as the platform yoke 60). In embodiments of the invention, the distal post 102 is fixedly secured to the utility platform assembly 16 such that the distal post 102 rotates with the utility platform assembly 16. The distal post 102 and the distal sprocket 100 rotate by the second angle as the utility platform assembly 16 rotates by the second angle. The platform interface bracket 104 may therefore secure the distal post 102 to the horizontally articulating arm 20 and/or at least a portion of the cutoff valve assembly 76 to a position proximate the distal angle detector 74 (as discussed below).

The band 78 will now be discussed in more detail, as best illustrated in FIGS. 5 and 6. The band 78 is secured around (or otherwise associated with) the distal angle detector 74 and the proximal angle detector 72. In embodiments of the invention, the band 78 is secured around the distal sprocket 100 of the distal angle detector 74 and the proximal sprocket 80 of the proximal angle detector 72. The band 78 communicates the relative positions of at least one of the angle detectors 72,74. In some embodiments, the band 78 mechanically communicates the second angle to the proximal angle detector 72. In some embodiments, the band 78 mechanically communicates by affecting an angle of the proximal sprocket 80 based at least in part on the second angle from the distal sprocket 100. This mechanical communication is used to determine whether the summation of the first angle and the second angle exceeds the maximum total angle (as discussed more below).

In some embodiments of the invention, the band 78 is a substantially continuous loop (not illustrated). In these embodiments, the band 78 may be elastic or constrictive such that the band 78 adheres to the two respective sprockets. The continuous loop may be used in embodiments of the invention that are not insulated, for simplicity reasons, or in which the continuous loop is formed of an insulated material.

In other embodiments of the invention, the band 78 comprises two flexible segments 108 and two rigid segments 110. The two rigid segments 110 are disposed opposite the other, and the two flexible segments 108 are disposed therebetween and opposite the other. As such, the band 78 forms a general pill shape when disposed around the two respective sprockets 80,100. Because the angles through which the sprockets can rotate is limited by the respective mechanical stops (discussed above), the rigid segments 110 may be disposed between the two respective flexible segments 108. The flexible segments 108 may be formed of any flexible material (such as rope, chain, polymers, or rubber).

In some embodiments of the invention, the band 78 comprises a first chain 112 (being the first flexible segment 108), a second chain 114 (being the second flexible segment 108), a first insulated rod 116 (being the first rigid segment 110) disposed between the first chain 112 and the second chain 114 on a right side, and a second insulated rod 118 (being the second rigid segment 110) disposed between the first chain 112 and the second chain 114 on a left side. The first chain 112 is configured to be secured around the proximal sprocket 80 of the proximal angle detector 72. The second chain 114 is configured to be secured around the distal sprocket 100 of the distal angle detector 74. In embodiments of the invention, the first chain 112 and the second chain 114 are formed of a metal and are similar to a standard bicycle chain (with the respective sprockets being similar to a standard bicycle gear), and the first insulated rod 116 and the second insulated rod 118 are at least partially formed of a polymer.

In embodiments of the invention, each of the first insulated rod 116 and the second insulated comprise a rod cap 120, a rod segment 122, a rod-bolt cap 124, a sizing bolt 126, and a bolt cap 128. The rod segment 122 is formed of a polymer or other insulated material, so as to prevent a discharge of electricity through the band 78. The rod cap 120, the rod-bolt cap 124, the sizing bolt 126, and the bolt cap 128 may each be formed of metal. The rod segment 122 is disposed between the rod cap 120 and the rod-bolt cap 124, and may be permanently secured therein. The sizing bolt 126 is disposed between the rod-bolt cap 124 and the bolt cap 128. The sizing bolt 126 is configured to be rotationally inserted into either or both of the rod-bolt cap 124 and the bolt cap 128. As such, the operator or installer may rotate the sizing bolt 126 and/or an associated nut 130 to achieve the desired tautness of the band 78. The operator or installer may also emplace the band 78 around the proximal angle detector 72 and the proximal angle detector 72 by securing the sizing bolt 126 into either or both of the rod-bolt cap 124 and the bolt cap 128.

The cutoff valve assembly 76 will now be discussed in greater detail, as best illustrated in FIGS. 5 and 6. The cutoff valve assembly 76 is configured to prevent movement of the utility platform assembly 16 upon being actuated. In various embodiments, the cutoff valve assembly 76 operates by cutting hydraulic power, pneumatic power, electrical power, or by applying a mechanical stop. The cutoff valve assembly 76 is in mechanical communication (either directly or indirectly) with the proximal angle detector 72 and the distal angle detector 74. The cutoff valve assembly 76 is associated with the distal angle detector 74 and the proximal angle detector 72 such that the cutoff valve assembly 76 is actuated if a summation of the first angle and the second angle exceeds a maximum total angle. The cutoff valve assembly 76 is actuated by an actuator 132 associated therewith is actuated by another component of the rotation limiter 22. The actuator 132 protrudes from the cutoff valve assembly 76 such that it may be depressed, pivoted, touched, or otherwise actuated.

In some embodiments of the invention, the cutoff valve assembly 76 comprises the cam wheel 96 and a valve assembly 134. The cam wheel 96 rotates relative to the valve assembly 134 in the total angle (e.g., the summation of the first angle and the second angle), as discussed below. The cam wheel 96 will actuate (or otherwise provide an indication to) the valve assembly 134 upon the rotation of the cam wheel 96 reaching or approaching the maximum total angle. It should be appreciated that the cam wheel 96 will actuate the valve assembly 134 upon reaching the maximum total angle in either the leftward or rightward rotation. It should also be appreciated that the maximum total angle for leftward may be different than the maximum total angle for rightward, depending on the relative geometries and symmetry of the various components.

The cam wheel 96 is fixedly secured to the cam mount 94. The cam wheel 96 may additionally or alternatively be fixedly secured to the proximal post 82. In embodiments of the invention, the cam wheel 96 is generally disk shaped so as to present a circular wall. The cam wheel 96 rotates about the rotation axis in conjunction with the horizontally articulating arm 20. The cam wheel 96 is adjacent to, or otherwise associated with the valve assembly 134, such that the cam wheel 96 can actuator or otherwise provide an indication to the valve assembly 134 that the cam wheel 96 (and by extension, the utility platform assembly 16) is in the maximum total angle.

In embodiments of the invention, the cam wheel 96 presents at least one cam protrusion 136. The cam protrusion **136*s* are configured to actuate the actuator 132 of the valve assembly 134 when the cam wheel 96 is rotated relative to the valve assembly 134 at the maximum total angle. The cam protrusion 136*s* extend radially from the circular wall of the cam wheel 96. The cam protrusion 136*s* are positioned on the circular wall at a location that is associated with the maximum total angle. For example, the cam protrusion 136*s* may be disposed away from the default aligned orientation for the cam wheel 96 by the maximum total angle. In some embodiments, the cam protrusion 136*s* may be customizable, such that the installer can select the maximum total angle that is appropriate for the aerial device 10 into which the horizontally articulating platform arm 18** is being installed.

The valve assembly 134 will now be discussed in greater detail. The valve assembly 134 is configured to cut power to the utility platform assembly 16 or otherwise arrest the further rotation of the utility platform assembly 16. In some embodiments, the valve assembly 134 may only cut power to prevent the utility platform assembly 16 from moving beyond the maximum total angle while allowing other movements of the utility platform assembly 16 (such as away from the maximum total angle). In other embodiments, the valve assembly 134 may cut all power to the utility platform assembly 16 such that the utility platform assembly 16 must be moved out of the maximum total angle by a set of lower boom controls or another secondary control system. In embodiments of the invention, the valve assembly 134 includes at least one actuator 132.

In some embodiments of the invention, the valve assembly 134 includes a left valve housing 138 and a right valve housing 140. The left valve housing 138 detects rotation in the leftward direction beyond the maximum total angle. The right valve housing 140 detects rotation in the rightward direction beyond the maximum total angle. The left valve housing 138 is secured to a left side 142 of the boom interface bracket 84 so as to prevent movement of the utility platform assembly 16 upon reaching or exceeding the maximum total angle in a leftward direction. The left valve housing 138 is actuated by a left cam protrusion 136. The right valve housing 140 is secured to a right side 144 of the boom interface bracket 84 so as to prevent movement of the utility platform assembly 16 upon reaching or exceeding the maximum total angle in a rightward direction. The right valve housing 140 is actuated by a right cam protrusion 136.

In other embodiments, not illustrated, the valve assembly 134 includes a single valve housing with two protrusions extending therefrom. Each of the two protrusions may be tripped by the respective cam protrusion **136*s*** reaching or exceeding the maximum total angle. Depending on which of the protrusions is tripped, the hydraulic or pneumatic power to continue movement in that direction will be dumped or otherwise released (so as to prevent further movement in that direction).

The valve housing includes an operating fluid interchange 146, an interior valve (not illustrated) and a dump outlet 148. Typically (e.g., when the valve assembly 124 has not been actuated), the hydraulic fluid will not pass through the valve to the dump outlet. This allows the hydraulic fluid to be utilized. The hydraulic line to the cutoff valve is teed off the main hydraulic line to the actuator such that, the hydraulic fluid does not pass through the cutoff valve enroute to the actuator. Upon the valve assembly 134 being actuated, the interior valve will moves such that at least a portion of the hydraulic fluid may exit via the dump outlet 148. The dump outlet 148 returns the hydraulic fluid to a tank associated with the hydraulic power system. The interior valve opening releases at least a portion of the hydraulic pressure from the hydraulic lines that are secured to the operating fluid interchange 146. This loss of pressure prevents the hydraulic fluid from being successfully utilized in performing additional tasks (such as continuing to move the utility platform assembly 16 into the boom assembly 14).

Various methods of the invention will now be discussed. A method of controlling a horizontally articulating platform arm 18 may include the following steps: receiving an indication that the utility platform assembly 16 has reached or exceeded the maximum total angle; opening a valve so as to release a powering fluid from the utility platform assembly 16; and closing the valve upon an indication that the utility platform assembly 16 is no longer reached or exceeded the maximum total angle. A method of installing a horizontally articulating platform arm 18 between a boom assembly 14 and a utility platform assembly 16 may include the following steps: securing a proximal end 52 of the horizontally articulating platform arm 18 to a distal end 34 of the boom assembly 14, such as at a platform leveler 56; securing a distal end 54 of the horizontally articulating arm 20 to the utility platform assembly 16, such as at a platform yoke 60; securing a band 78 around a proximal angle detector 72 and a distal angle detector 74 of the horizontally articulating platform arm 18; and securing a set of hydraulic lines to the horizontally articulating platform arm 18 from both the base 12 of the aerial device 10 and the utility platform assembly 16, such that a valve assembly 134 of the horizontally articulating platform arm 18 is configured to dump hydraulic fluid to the tank upon the utility platform assembly 16 exceeding the maximum total angle.

Although the invention has been described with reference to the embodiments illustrated in the attached drawing figures, it is noted that equivalents may be employed and substitutions made herein without departing from the scope of the invention as recited in the claims.

The invention claimed is:

1. A horizontally articulating platform arm comprising:

a horizontally articulating arm comprising a proximal end and a distal end, wherein the proximal end of the horizontally articulating arm is pivotably secured to a boom assembly by a proximal pivot, wherein the distal end of the horizontally articulating arm is pivotably secured to a utility platform assembly by a distal pivot, wherein the horizontally articulating arm is coaxially aligned with the boom assembly and the utility platform assembly, wherein a first angle is presented between the horizontally articulating arm and the boom assembly when the horizontally articulating arm is pivoted relative to the boom assembly at the proximal end;

wherein a second angle is presented between the horizontally articulating arm and the utility platform when the utility platform assembly is pivoted relative to the horizontally articulating arm at the distal end; and a rotation limiter assembly connected to the proximal pivot and the distal pivot and comprising a band for translating rotation from the proximal pivot to the distal pivot, wherein the band comprises at least one rigid segment and at least one flexible segment translating rotation from the first proximal pivot to the distal pivot;

wherein the rotation limiter assembly mechanically stops the horizontally articulating arm and the utility platform assembly from pivoting when a summation of the first angle and the second angle exceed a maximum total angle.

2. The horizontally articulating platform arm of claim 1, wherein the rotation limiter assembly prevents the utility platform assembly from exceeding the maximum total angle, and wherein the rigid segment of the band is insulated to prevent electric discharge through the band, and wherein the flexible segment is a chain.

3. The horizontally articulating platform arm of claim 1, wherein the horizontally articulating arm rotates about the proximal pivot relative to the boom assembly from an aligned configuration up to a maximum first angle;

wherein the horizontally articulating arm allows the utility platform assembly to rotate about the distal pivot relative to the horizontally articulating arm from the aligned configuration up to a maximum second angle.

4. The horizontally articulating platform arm of claim 3, wherein the maximum first angle is substantially equal to the maximum second angle.

5. The horizontally articulating platform arm of claim 3, wherein the maximum total angle is less than a summation of the maximum first angle and the maximum second distal angle.

6. The horizontally articulating platform arm of claim 1, wherein the rotation limiter assembly comprises:

a proximal angle detector;

wherein the proximal angle detector detects the first angle;

a distal angle detector, wherein the distal angle detector detects the second angle; and a cutoff valve assembly in contact with the proximal angle detector;

wherein the cutoff valve assembly prevents movement of the utility platform assembly upon being actuated, wherein the cutoff valve assembly is actuated by the proximal angle detector if a summation of the first angle and the second angle exceeds the maximum total angle.

7. A horizontally articulating platform arm comprising:

a horizontally articulating arm comprising a proximal end and a distal end, wherein the proximal end of the horizontally articulating arm is pivotably secured to a boom assembly, wherein the distal end of the horizontally articulating arm is pivotably secured to a utility platform assembly, wherein the horizontally articulating arm is coaxially aligned with the boom assembly and the utility platform assembly, wherein a first angle is presented between the horizontally articulating arm and the boom assembly when the horizontally articulating arm is pivoted relative to the boom assembly at the proximal end;

wherein a second angle is presented between the horizontally articulating arm and the utility platform when the utility platform assembly is pivoted relative to the horizontally articulating arm at the distal end; and a rotation limiter assembly comprising:

a proximal angle detector, wherein the proximal angle detector detects the first angle by rotating based on the rotation of the horizontally articulating arm;

a distal angle detector, wherein the distal angle detector detects the second angle by rotating based on the rotation of the utility platform assembly;

a band secured to the distal angle detector and the proximal angle detector;

wherein the band translates the rotation of the distal angle detector to the proximal angle detector;

said band comprising at least one rigid segment and at least one flexible segment; and a cutoff valve connected to the proximal angle detector, wherein the cutoff valve actuates to prevent the horizontally rotating arm and the utility platform assembly from pivoting when a summation of the first angle and the second angle exceed a maximum total angle.

8. The horizontally articulating platform arm of claim 7, wherein the at least one rigid segment is insulated to prevent the discharge of electricity through the band.

9. The horizontally articulating platform arm of claim 7, wherein the horizontally articulating arm rotates about the proximal pivot relative to the boom assembly from the aligned configuration up to a maximum first angle, wherein the utility platform assembly rotates about the distal pivot up to a maximum second angle.

10. The horizontally articulating platform arm of claim 9, wherein the maximum first angle is substantially equal to the maximum second angle.

11. A horizontally articulating platform arm comprising:

a horizontally articulating arm comprising a proximal end and a distal end, wherein the proximal end of the horizontally articulating arm is pivotably secured to a boom assembly, wherein the distal end of the horizontally articulating arm is pivotably secured to a utility platform assembly, wherein the horizontally articulating arm is coaxially aligned with the boom assembly and the utility platform assembly, wherein a first angle is presented between the horizontally articulating arm and the boom assembly when the horizontally articulating arm is pivoted relative to the boom assembly at the proximal end;

wherein a second angle is presented between the horizontally articulating arm and the utility platform when the utility platform assembly is pivoted relative to the horizontally articulating arm at the distal end; and a rotation limiter assembly comprising:

a proximal angle detector, wherein the proximal angle detector detects the first angle by rotating based on the rotation of the horizontally articulating arm;

a distal angle detector, wherein the distal angle detector detects the second angle by rotating based on the rotation of the utility platform assembly;

a band secured to the distal angle detector and the proximal angle detector;

a proximal sprocket configured to receive at least a portion of the band therearound;

a proximal post axially aligned with and secured to the proximal sprocket, wherein the band translates the rotation of the distal angle detector to the proximal angle detector; and a cutoff valve connected to the proximal angle detector, wherein the cutoff valve actuates to prevent the horizontally rotating arm and the utility platform assembly from pivoting when a summation of the first angle and the second angle exceed a maximum total angle.

12. The horizontally articulating platform arm of claim 11, wherein a cam wheel is in contact with the cutoff valve and actuates the cutoff valve when the summation of the first angle and the second angle exceed the maximum total angle.

13. The horizontally articulating platform arm of claim 12, wherein the cutoff valve comprises at least one valve housing secured to the boom interfacing bracket.

14. The horizontally articulating platform arm of claim 13, wherein the boom interfacing bracket further secures the proximal post to the horizontally articulating arm.

15. The horizontally articulating platform arm of claim 11, wherein the band comprises at least one flexible segment.

16. The horizontally articulating platform arm of claim 15, wherein the band comprises at least one rigid segment.

17. The horizontally articulating platform arm of claim 16, wherein the at least one rigid segment comprises an insulative material to preventing electrical discharge through the band.

18. The horizontally articulating platform arm of claim 17, wherein the insulative material is a polymer.

19. The horizontally articulating platform arm of claim 16, wherein the at least one rigid segment is a polymer and is disposed between two flexible segments.

20. The horizontally articulating platform arm of claim 19, wherein the two flexible segments are chains.

* * * * *